United States Patent [19]

Batson

[11] 4,265,154

[45] May 5, 1981

[54] MOTORIZED MITER SAW FENCE MOUNTING

[75] Inventor: William A. Batson, Pickens, S.C.

[73] Assignee: The Singer Company, Stamford, Conn.

[21] Appl. No.: 84,493

[22] Filed: Oct. 15, 1979

[51] Int. Cl.[3] ..... B27B 5/20

[52] U.S. Cl. ..... 83/468; 83/471.2; 83/477; 83/490; 83/581; 269/304; 269/317

[58] Field of Search ..... 83/467, 468, 471.2, 83/473, 477, 477.2, 490, 581; 269/303, 304, 315, 317

[56] References Cited

U.S. PATENT DOCUMENTS

| | | | |
|---|---|---|---|
| 1,193,385 | 8/1916 | Hieatzman | 83/471.2 |
| 3,105,528 | 10/1963 | Loughridge | 83/477 X |
| 3,901,498 | 8/1975 | Novak | 83/581 X |

*Primary Examiner*—J. M. Meister

*Attorney, Agent, or Firm*—Elliot A. Lackenbach; Robert E. Smith; Edward L. Bell

[57] ABSTRACT

A motor operated circular miter chop saw is pivotally mounted on a generally horizontal axle pivot bolt about which it rotates in a vertical plane with the axle pivot bolt being carried by a cast support base structure. Angular orientation of the work piece is provided by an angularly adjustable fence rotatably carried by the cast base support structure with the fence having a generally downwardly open circularly arcuate groove cooperating with a pair of machined steel pins pressed into the cast base support structure. The cast base support structure is also provided with an arcuate slot to provide clearance for the circular saw blade and leaf spring means are provided carried by the cast support base bias the fence rearwardly so that the pins engage against the inward wall of the fence groove.

8 Claims, 3 Drawing Figures

MOTORIZED MITER SAW FENCE MOUNTING

FIELD OF THE INVENTION:

This invention relates to powered circular saws and, more particularly, to a novel fence mounting for a powered circular saw hingedly mounted to a table having a rotatably positionable fence for cutting elongated stock material such as wood to length at various reproducable angles.

BACKGROUND OF THE INVENTION

In various crafts projects it is useful to be able to accurately cut elongated stock material, such as strips of wood, or the like, to length and at accurately reproducable angles. For example, in many construction projects it is desired to cut strips of wood so that the end cut is square, that is perpendicular to the longitudinal axis of the wood strip. At other times it is desirable to cut at angles other than 90° such as at a 45° angle to enable two such strips to be mitered to provide a square or right angle corner joint. Motorized miter saws, in which a power driven circular saw is pivotally supported on a support member for vertical swinging movement downwardly from a normal inoperative rest position towards a work support base structure while also pivotally supporting the saw support member on a vertical axis for angular swinging movement to preselected angular positions to effect a desired angle cutting of the work piece have been previously shown and saws of this type are disclosed, for example, in Niehaus et al U.S. Pat. No. 3,821,918 and are commonly referred to as chop saws. A disadvantage of such saws is the necessity for pivoting the saw assembly for angular setting and the weight and vibration of the saw necessitates that the saw support member be rather heavy and closely machined to provide for long life and continued accuracy. Among other disadvantages, this necessity makes such construction more expensive than might be otherwise desirable. Moreover, since the saw blade must descend to a position beneath the work supporting surface in order to completely sever the work piece, means must be provided to enable the saw to pass through the work supporting surface at a number of angular positions which further increases the complexity and, accordingly, the cost of such saws. In some saws this is achieved by providing a rotating platform which rotates with the saw, further adding to the complexity and expense of the machine. If such means are not provided, then a disposable work supporting surface, such as a piece of scrap wood, must be used beneath the work piece of a movable fence, or the like may be provided to enable relative lateral movement of the work piece and the saw path, therefore necessitating both the chopping movement of the saw and lateral movement of the work piece of saw which results in a loss of convenience and a possible lessening of accuracy as well as an increase in complexity and expense. In the present saw the difficulties are reduced by providing a pivotal fence for positioning the work piece and a fixed chordal clearance in the saw base for the saw blade together with novel and improved means for mounting the fence in position while guiding it for pivotal movement on the saw base.

Without getting into truly massive or welded structures for the work support base structure, the most economical base fabrication method to provide the requisite rigidity and strength is to cast the structure of metal. While such cast structures are basically inexpensive in comparison with a welded structure, a cast structure has the basic inconvenience that working surfaces need to be subsequently machined because the surface finish produced by processes such as sand casting are generally insufficient for work supporting surfaces and for bearing surfaces about which the miter fence pivots. Moreover, because of the limitation of the sand casting process and the contraction of metal during cooling following casting, actual dimensions are subject to substantially large tolerances which necessitate that critical surfaces and the structure defining pivotal axis be subsequently machined and each machining operation necessitated by the design generally increases the cost of the machine. The novel fence mounting of the present invention provides accurate positioning of the fence while yet minimizing the amount of machining necessary. By positioning the fence against a pair of machined steel pins pressed into the base and biasing the fence by spring means against the pins.

OBJECTS OF THE INVENTION

Accordingly, it is a primary object of the present invention to provide novel and improved miter saws designed, constructed and arranged to maximize economy of production while simultaneously maintaining acceptable accuracy.

Another primary object of the present invention, in addition to the foregoing object, is the provision of novel and improved miter saws utilizing a cast base structure to which a motor powered circular chop saw is pivotally mounted for rotation about a horizontal axis and a work piece fence is pivotally mounted for rotation about a vertical axis intersecting the saw axis, wherein a minimum of machining is required to the base structure casting for mounting and guiding of the fence.

Yet another primary object of the present invention, in addition to each of the foregoing objects, is the provision of such a miter saw wherein novel and improved mounting means are utilized for mounting the fence to the base support structure so as to enable accurate orientation of the fence relative the base support structure while minimizing machining of the cast base support structure and the fence.

Still another primary object of the present invention, in addition to each of the foregoing objects, is the provision of novel and improved motor powered circular miter chop saws wherein rotation of the motor powered chop saw relative to the base is not required for adjustment of angular orientation to the work piece to be cut, such adjustment of angular orientation being provided by pivotably mounting the fence with the cast mounting base structure by means of machined steel pins pressed into the base.

Yet still another primary object of the present invention, in addition to each of the foregoing objects, is the provision of such motor driven miter chop saws wherein the rotational axis for the fence relative the cast base support structure is provided by a circular groove in the fence cooperating with a pair of upstanding steel pins pressed into the base extending into the groove together with a leaf spring biasing the fence rearwardly against the pins.

Yet still another and further primary object of the present invention, in addition to each of the foregoing objects, is the provision in a motor driven circular miter chop saw of the class described of an angularly adjustable and lockable fence against which a work piece may be positioned to define the angle of cut thereof and thereby enabling the angular orientation of the chop saw laterally of the cast support base upon which the work piece may also be supported to be fixed so that a single arcuate segmental recess may be provided for clearance of the circular saw blade to sever the work piece at any desired angle by mere lowering pivotal action of the chop saw.

Yet another and still further primary object of the present invention, in addition to each of the foregoing objects, is the provision in a motor driven circular miter chop saw of the class defined, of detent means between the base and the angularly adjustable fence to define especially desirable angular orientation adjustments thereof such as, for example, square or 90° cutting (alternatively referred to a 0° of miter) and 45° cutting orientations.

A yet still further primary object of the present invention, in addition to each of the foregoing objects, is the provision, in a motor driven circular miter chop saw of the class defined, of locking means for the fence to positively maintain the fence aligned in a desired angular orientation.

It is a feature of the present invention that the saw is constructed primarily from relatively inexpensive castings eliminating a number of parts from those utilized in conventional construction, therefore requiring only a minimum of machined parts and thereby maximizing economy of manufacture while yet providing an accurate and durable tool.

The invention resides in the combination, construction, arrangement and disposition of various component parts and elements incorporated in improved motor driven circular miter chop saws and fence mounting and guiding means therefore constructed in accordance with the principles of this invention. The present invention will be better understood and objects and important features other than those specifically enumerated above will become apparent when consideration is given to the following details and description which, when taken in conjunction with the annexed drawing describes, discloses, illustrates and shows a preferred embodiment or modification of the present invention and what is presently considered and believed to be the best mode of practicing the principles thereof. Other embodiments and modifications may be suggested to those having the benefit of the teachings herein, and such other embodiment or modifications are intended to be reserved, especially as they fall within the scope and spirit of the subjoined claims.

SUMMARY OF THE INVENTION

In accordance with the present invention a motor operated circular miter chop saw is pivotally mounted on a generally horizontal axle pin or bolt about which it rotates in a vertical plane with the axle bolt being carried by a cast support base structure. Angular orientation of the work piece is provided by an angularly movable fence rotatably carried by the cast base support structure with the fence having a downwardly open arcuate slot or groove cooperating with a pair of steel pins pressed into the cast base support structure. The cast base support structure is also provided with an arcuate slot extending perpendicular the chop saw axle bolt to provide clearance for the circular saw blade and a leaf spring biasing the fence rearwardly against the pins. Detent means are provided for locating the rotatable fence structure for work piece cut off at a right angle or 90° (sometimes referred to as 0° of miter) as well as at 45° right and left orientation. Lock means are also provided for firmly locking the fence in a desired orientation, whether in the detent position or any position therebetween.

While the saw described is primarily intended for the cutting of soft material such as wood, utilizing a wood cutting blade, it is intended that this application also cover similar devices provided with metal cutting blades, abrasive discs, and the like, for cutting and facing diverse materials.

BRIEF DESCRIPTION OF THE DRAWING

Further objects and features of the present invention will appear from the following description and appended claims when read in conjunction with the accompanying drawing wherein:

DETAILED DESCRIPTION OF THE INVENTION

Figure 1:
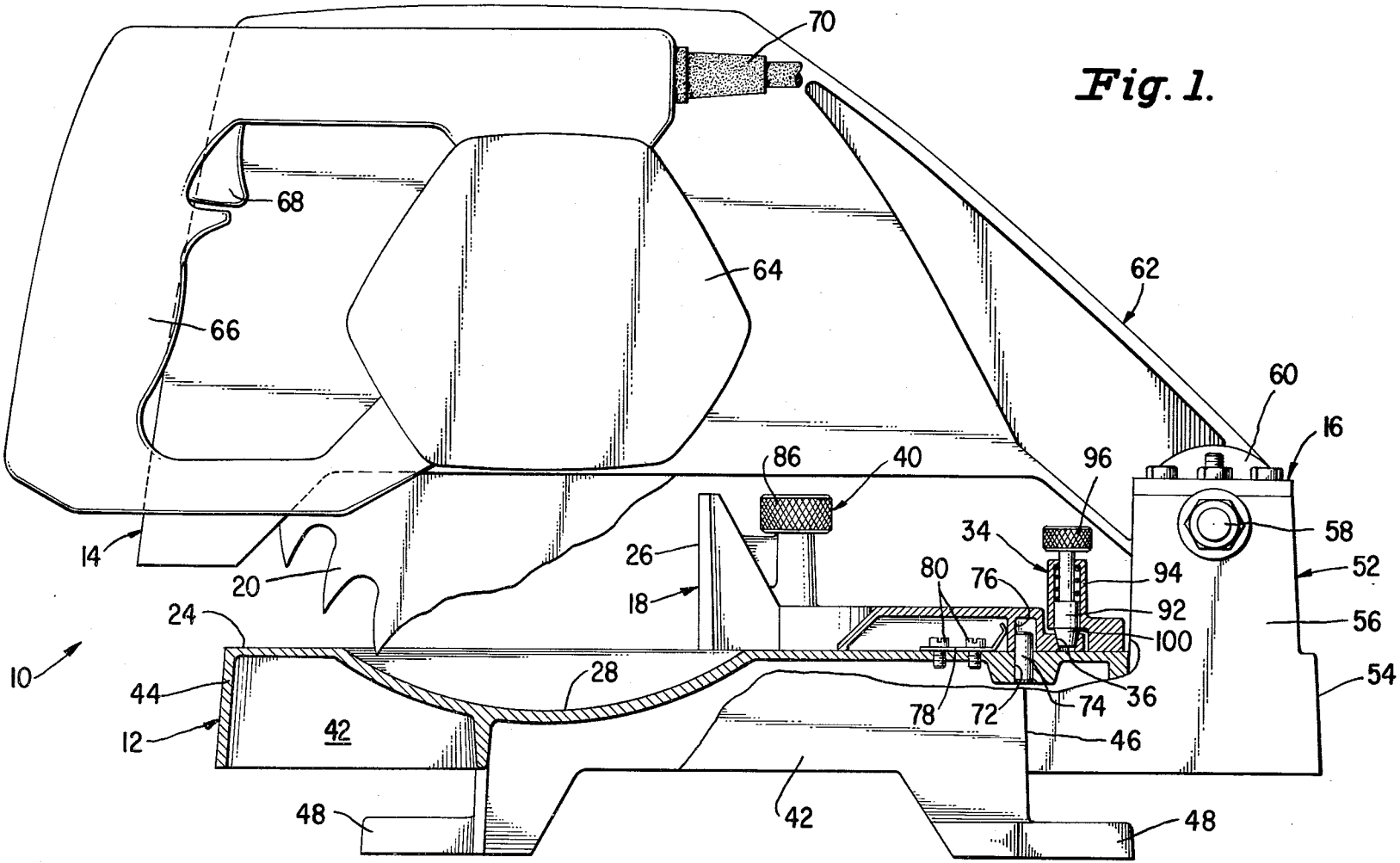
FIG. 1 is a side elevational view, partially broken away, of a motorized circular miter chop saw constructed in accordance with the present invention.
Figure 2:
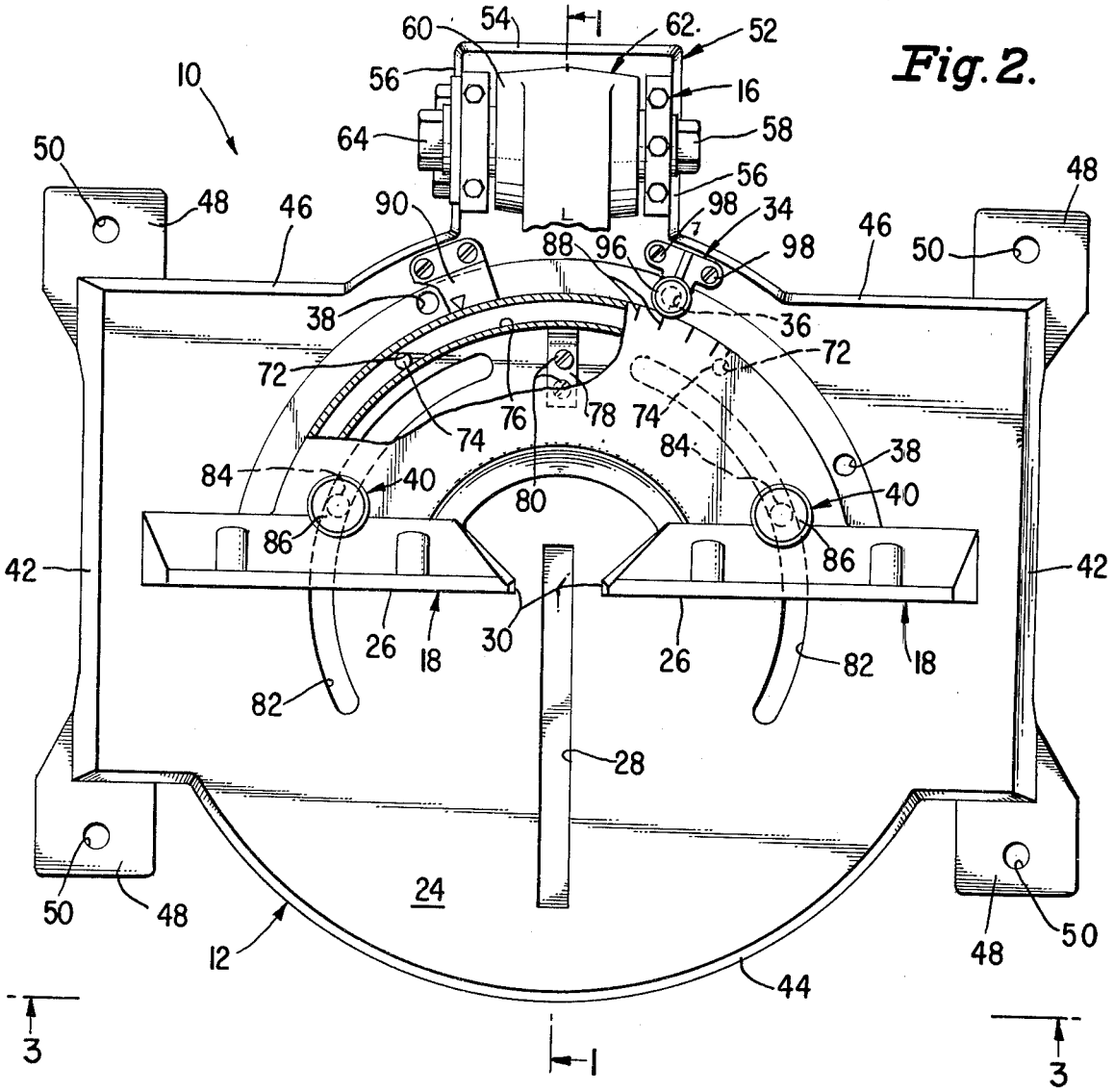
FIG. 2 is top plan view of the chop saw shown in FIG. 1 partially broken away.
Figure 3:
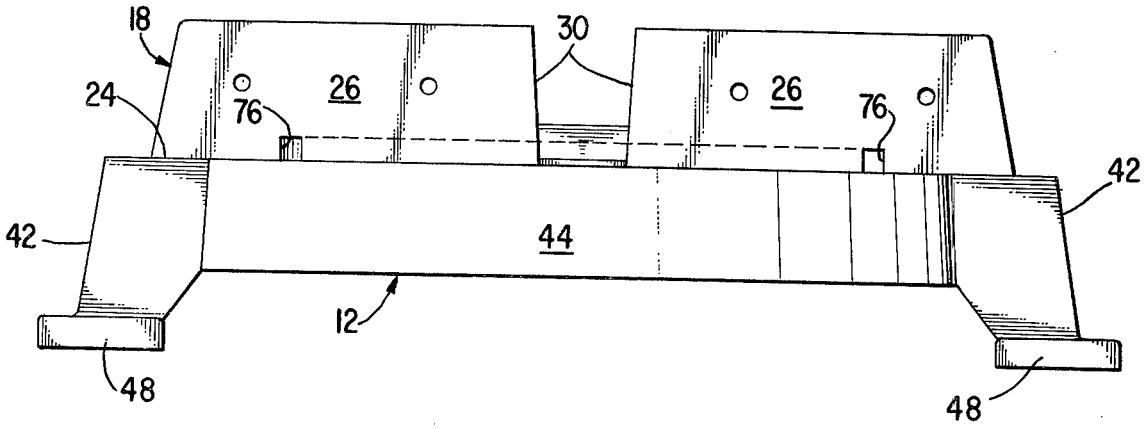
FIG. 3 is partial elevational view base portion and the fence of the saw of the preceding views, viewed from line 3—3.

With reference now to the drawing, there is shown and illustrated a motor operated circular miter chop saw constructed in accordance with the principles of the present invention and designated generally by the reference character 10. The miter saw 10 comprises a cast base structure designated generally by the reference character 12, a motor driven circular saw structure designated generally by the reference character 14 rotatably carried on a pivot assembly generally designated by the reference character 16 mounted with the cast base structure 12 and a rotatable fence structure designated generally by the reference character 18 rotatably carried by the cast base structure 12 for limited rotational movement about a vertical pivot located on or adjacent the plane of the circular saw blade 20 of the motor driven circular saw 14. In addition, biasing means (not shown) and more particularly described in detail in my copending application Ser. No. 061,163 filed July 26, 1979 executed by me July 9, 1979, and incorporated herein in its entirety by reference, may be provided for biasing the circular saw 14 in an upward direction towards an open position whereat the circular saw 14 is generally spaced above the cast base portion structure 12 for the insertion of an elongated work piece therebetween to rest on a work supporting surface 24 defined by the top surface of the cast base portion 12 and against the work supporting face 26 on the fence structure 18 generally perpendicular the work supporting surface 24. A generally arcuate depression or clearance slot 28 is provided in the cast base structure 12 in general alignment with the circular saw blade 20 to enable the circular saw blade 20 to pass through the plane of the work supporting surface 24 as the saw is lowered against the force of the biasing means to cut the work piece. The fence structure 18 is also provided with a generally central slot 30 to provide clearance for the saw blade for the same purpose, the slot being wide enough to accommodate the saw blade 20 even at the extremes of the fence rotation. Stop means (not shown) such as that also more fully described in my aforesaid copending application may also be provided for limiting the downward pivoting chop motion of the motorized circular saw 14 to prevent the circular saw blade 20 from contacting the bottom of the saw clearance groove 28 or the fence structure 18 rearward of the saw clearance slot 30. Detent means designated generally by the reference character 34 are provided to quickly and easily locate the fence structure 18 rotatably in any of several preferred positions such as, for example, perpendicular the plane of the saw blade 20 and at 45° angles right and left thereof by cooperation with either a central cup detent 36 or either of to offset cup detents 38 offset 45° from the central detent 36. A pair of locking means designated generally by the reference character 40 are also provided for positively locking the fence structure 18 in a desired angular orientation.

In addition to the upper work supporting surface 24, the cast base structure 12 further comprises a pair of side walls 42, a front wall 44 and a rear wall 46, each depending therefrom with laterally outwardly extending feet 48 being integral with the lower edges of the walls 42, 44 and 46 at the four corners for supporting the miter chop saw 10 on a table, or the like. Mounting apertures 50 are provided in each foot 48 to enable the miter chop saw 10 to be fastened in position. Projecting generally rearwardly of the rear wall 46 of the cast base structure 12 and forming an integral part thereof, there is provided a generally U-shaped channel portion 52 having a rear wall 54 generally parallel of the rear wall 46 and a pair of side wall portions 56 generally parallel the side walls 42 and extending upwardly above the plane of the work supporting surface 24 to define a pair of mounting ears forming a part of the circular saw mounting means 16.

As heretofore pointed out, the circular saw structure 14 is pivotally mounted, and the support means 16 therefore comprises a pin or pivot bolt 58 extending through the side wall 56 and adjustably mounted therein as is described in more detail in my aforesaid copending application incorporated herein by reference. The bolt 58, as set forth therein extends through a boss 60 integrally formed with a blade guard and motor supporting casting 62 forming the main supporting structure of the circular saw structure 14 and is secured with a nut 64. The blade guard casting 62 has an electric motor 64 mounted to one side thereof for driving the circular saw blade 20 and carries a handle portion 66 for enabling the circular saw assembly 14 to be controlled, i.e., lowered for cutting action and raised, and a trigger switch 68 for selectively energizing the motor 64 from a power cord 70.

The work supporting surface 24 of the cast base structure 12 is provided with a pair of apertures 72 into which there are pressed a pair of generally cylindrical machined steel bearing pins 74 for guiding the fence structure 18 which is provided with a generally downwardly open circularly arcuate groove 76, the inward wall of which is urged against the pins 74 by means of a biasing leaf spring 78 mounted to the base 18, as by means of screws 80. The leaf spring 78, therefore, biases the fence 18 generally outwardly against the pins 74. The cast base structure 12 is also provided with circularly arcuate slot segments 82 through which a pair of carriage bolts, or the like, 84 are provided as part of the locking means 40 for locating the fence structure 18 in a desired angular orientation. Cooperating with the carriage bolts 84 are a pair of crown nuts 86 which, when tightened on the carriage bolts 84 are effective to lock the fence structure 18 in a desired angular orientation. The fence structure 18 may further comprise angular degree markings 88 and there may also be provided on the cast base structure 12 an indicator means 90 adjacent thereto. It will be noted that the indicator means 90 and the angular degree markings 80 may be offset from the angle of the fence face 26 so as not to be obscured by the blade guard 14. The detent means 34 may comprise a detent spindle 92 held in a socket 94 and operable by a knob 96, with the socket 94 being mounted to the cast base support structure 18, as by means of screws 98. The nose portion 100 of the spindle 94 may be tapered, as shown to mate with the cup detents 36 and 38.

It is to be understood that the invention is by no means limited to the forms of embodiment described and illustrated, which have been given by way of example only. In particular, it comprises all the means constituting technical equivalents to the means described as well as their combinations, should the latter be carried out according to the spirit of the invention.

I claim:

1. Miter saw comprising a cast base structure having a generally planar work support surface to which a motor powered circular chop saw is pivotally mounted for rotation about about an axis generally parallel said work support surface and a work piece positioning fence pivotally carried by said base support structure for rotation about an axis generally perpendicular both said surface and said first mentioned axis, together with means for guiding and restraining said fence for pivotal movement about said second mentioned axis, said guiding and restraining means comprising a pair of pins pressed into said work support surface projecting generally normally upwardly thereof and a cooperating generally circularly arcuate generally downwardly open groove in the under surface of said fence.

2. Miter saw defined in claim 1 wherein said guiding and restraining means further comprises means for biasing said fence generally rearwardly against said pins whereby said pins engage against the inner wall of said groove.

3. Miter saw defined in claim 2 wherein said biasing means comprises a leaf spring carried by said base structure.

4. Miter saw defined in any of claims 1–3 further comprising detent means on said angularly adjustable fence to define especially desirable angular orientation adjustments thereof such as, for example, square or 90° cutting and 45° cutting orientations.

5. Miter saw defined in any of claims 1–3 further comprising means for locking said fence relative said saw in any desired angular orientation.

6. In a miter saw comprising a cast base structure having a generally planar work support surface to which a motor powered circular chop saw is pivotally mounted for rotation about an axis generally parallel said work support surface and a work piece positioning fence pivotally carried by said base support structure for rotation about an axis generally perpendicular both said surface and said first mentioned axis;

means for guiding and restraining said fence for pivotal movement about said second mentioned axis, said guiding and restraining means comprising a pair of pins pressed into said work support surface projecting generally normally upwardly thereof and a cooperating generally circularly arcuate generally downwardly open groove in the under surface of said fence.

7. Miter saw defined in claim 6 wherein said guiding and restraining means further comprises means for biasing said fence generally rearwardly against said pins whereby said pins engage against the inner wall of said groove.

8. Miter saw defined in claim 7 wherein said biasing means comprises a leaf spring carried by said base structure.

* * * * *